US005568246A

United States Patent [19]

Keller et al.

[11] Patent Number: 5,568,246

[45] Date of Patent: Oct. 22, 1996

[54] HIGH PRODUCTIVITY DUAL ENGINE SIMPLEX AND DUPLEX PRINTING SYSTEM USING A REVERSIBLE DUPLEX PATH

[75] Inventors: Paul D. Keller, Webster; Glenn M. Keenan; Lloyd F. Bean, II, both of Rochester, all of N.Y.

[73] Assignee: Xerox Corporation, Stamford, Conn.

[21] Appl. No.: 537,054

[22] Filed: Sep. 29, 1995

[51] Int. Cl.[6] ..... G03G 21/00

[52] U.S. Cl. ..... 355/309; 355/319; 355/325; 355/314; 271/288

[58] Field of Search ..... 355/321, 318, 355/319, 320, 322, 325, 309, 314; 400/605; 271/288

[56] References Cited

U.S. PATENT DOCUMENTS

| | | | |
|---|---|---|---|
| 4,229,101 | 10/1980 | Hamlin | 355/77 |
| 4,427,285 | 1/1984 | Stange | 355/3 FU |
| 4,958,187 | 9/1990 | Tsuchiya et al. | 355/319 X |
| 4,972,236 | 11/1990 | Hasegawa | 355/319 |
| 5,083,144 | 1/1992 | Altermann | 355/220 |
| 5,115,281 | 5/1992 | Ohtsuka et al. | 355/319 |
| 5,150,167 | 9/1992 | Gonda et al. | 355/319 X |
| 5,179,417 | 1/1993 | Sugaya et al. | 355/319 |
| 5,272,511 | 12/1993 | Conrad et al. | 355/325 |
| 5,337,135 | 8/1994 | Malachowski et al. | 355/319 |

*Primary Examiner*—R. L. Moses

[57] ABSTRACT

In a dual engine printing system producing a multipage print job from first and second serially connected printing engines at a common output from the second engine, where the second printing engine has a duplex return path bypassing its printing path and extending substantially therethrough, a high productivity simplex job printing mode is provided in which alternate pages are substantially simultaneously printed in both the first and second printing engines, but the alternate pages printed in the first printing engine are fed to the second printing engine duplex return path to bypass the printing path of the second printing engine and then are automatically interleaved in the common output with the alternate pages printed in the second printing engine. The duplex return path is preferably a bidirectional loop extending above the printing path and driven in a reverse sheet feeding direction for this simplex printing. In an alternate duplex job tandem printing mode, sheets printed on one side in the first printing engine are inverted and fed directly to the printing path of the second printing engine for printing their opposite sides and outputted directly to the common output. Both printing engines may be substantially identical and capable of independent duplex printing with the duplex return path driven in the forward sheet feeding direction.

6 Claims, 1 Drawing Sheet

Figure 1:
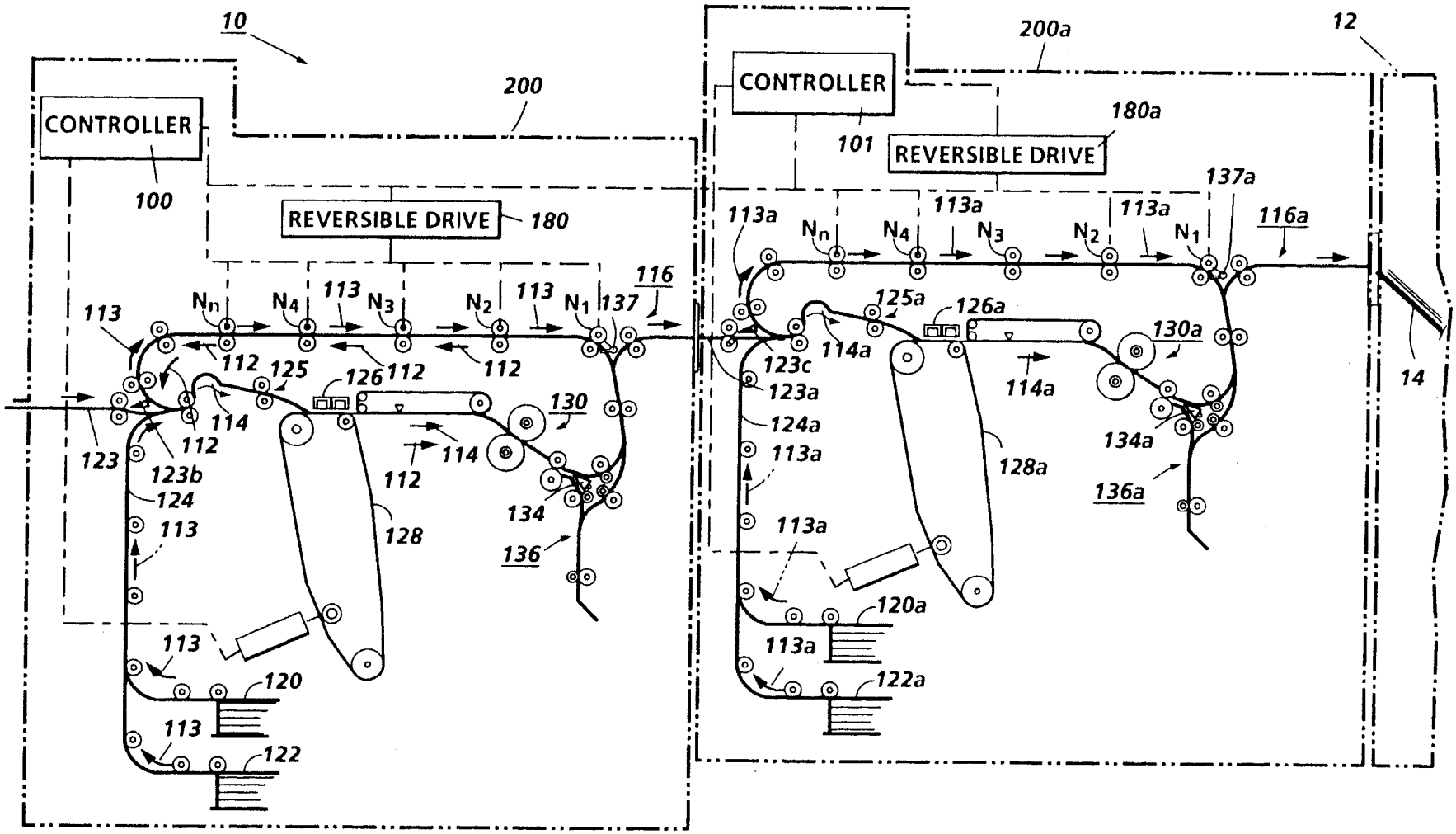

HIGH PRODUCTIVITY DUAL ENGINE SIMPLEX AND DUPLEX PRINTING SYSTEM USING A REVERSIBLE DUPLEX PATH

Cross-reference is made to a copending commonly assigned application of even date by the same assignee and first two inventors, filed Sep. 25, 1995, U.S. application Ser. No. 08/537,055.

Disclosed is an improved system for higher productivity simplex, as well as duplex, printing with dual operatively combined printing engines (dual reproduction apparatus), and additionally disclosing a reversible (bidirectional) duplex path utilized for said higher productivity printing.

Higher productivity simplex and duplex printing, at twice the printing rate of any one print engine, yet with properly collated output enabling on-line finishing, can be provided as disclosed herein by printing in simplex mode only the opposite alternating pages of a simplex document in each print engine at its full printing or copying rate, and combining their outputs at a single output location.

As disclosed in the exemplary embodiment here, the latter may be advantageously accomplished by connecting the two print engines in series with the second print engine receiving the alternating simplex pages from the first print engine, reversing the duplex path of the second print engine (which here has a duplex return path which extends from one side to the other of the upper potion of the downstream print engine) so that the alternating simplex pages from the first print engine bypass the image transfer system and fusing system of the second print engine by passing through this reversed duplex return path, yet are merged in a common output path from the second print engine interleaved with the other alternate pages of the simplex document simultaneously printed in the second print engine.

Other disclosed advantages of the disclosed embodiment herein include the combined, integrated, output of both print engines serially through both print engines to a shared single output and/or finisher, the utilization of a duplex path which extends from one side to the other of at least the downstream print engine as an optional sheet bypass path therethrough, and optional bypass modes of operation for partial jams or disablements of either print engine to enable at least partial continued use and operation. The two printers utilized may desirably be basically standard standalone printers in almost all respects, docked together output to input, rather than expensive specially built tandem engine machines.

Various types of dual engine duplex printers are known in the art. The following patent disclosures are noted as examples among many: Xerox Corp. U.S. Pat. Nos. 4,427,285; 3,536,398; 3,548,783; 3,694,073; 3,940,210. Likewise, numerous single copiers and printers with duplex and simplex printing capabilities are known, such as Xerox Corp. U.S. Pat. Nos. 5,095,342; 5,184,185; and 4,918,490.

Of particular interest thereto is Xerox Corp. U.S. Pat. No. 5,337,135 issued Aug. 9, 1994 (D/92065) by Michael Malachowski et al on a single higher productivity trayless duplex printer with a duplex return path shaped like that of the embodiment shown herein (and variable velocity, but not reversible). Also, the somewhat similar duplex path of the publication dated July/August 1994 in the "Xerox Disclosure Journal", Vol. 19, No. 4, pp. 333–336 by John R. Yonovich.

Also of interest is Xerox Corp. U.S. Pat. No. 4,229,101 issued Oct. 21, 1980 to Hamlin et al (D/76569D) disclosing a duplex to simplex copying system in which in a single print engine makes copies of alternate simplex pages on one imaging pass of the duplex document set in the recirculating document feeder which are stored in a duplex buffer tray and then fed out directly to a common output, by reversal of rollers 125 just downstream of the duplex tray output, bypassing the imaging station and fuser, to be interleaved with the alternate pages of the document subsequently copied from the other sides of the duplex document set. Compatible duplex copying is also disclosed.

On a separate background topic, it is known to interleave pre-printed covers or other insert sheets into the printer output stream of copies, e.g., Xerox Corp. U.S. Pat. Nos. 5,272,511 and 4,602,776; and Eastman Kodak Co. U.S. Pat. No. 4,248,525; etc.

A specific feature of the specific embodiments disclosed herein is to provide a dual engine printing system for producing a multipage print job with first and second printing engines, by passing sheets to be printed through both said first and second printing engines, in that order, to a common output from said second printing engine, and wherein said first and second printing engines each have a printing path therethrough with an entrance and exit, the improvement in said dual engine printing system wherein said second printing engine has a duplex return path bypassing said printing path of said second printing engine, said duplex return path extending substantially from one side of said second printing engine to the other side to optionally return sheets printed on one side from said printing path exit back to said printing path entrance of said second printing engine, and wherein a higher productivity simplex print job printing mode is provided in which alternate pages of a simplex print job are substantially simultaneously printed in said first and second printing engine, and wherein said alternate pages of the said simplex print job printed in said first printing engine in said higher productivity simplex printing mode are fed from said exit of said printing path of said first printing engine to said second printing engine duplex return path to bypass said printing path of said second printing engine, and wherein said alternate pages from said first printing engine are automatically interleaved in said common output with said alternate pages printed in said second printing engine after said alternate pages from said first printing engine have fed through said second printing engine duplex return path.

Further specific features provided by the system disclosed herein, individually or in combination, include those wherein said duplex return path is a bidirectional sheet feeding path with a reversible drive selectively driven in forward and reverse sheet feeding directions, and wherein in said higher productivity simplex print job printing mode said duplex return path is driven in said reverse sheet feeding direction; and/or wherein said duplex return path comprises a loop path extending through said second printing engine above said printing path thereof; and/or wherein said first and second printing engines are substantially identical independent duplex printing engines capable of independent simplex and duplex printing; and/or wherein said first and second printing engines are substantially identical, and wherein both have said duplex return path, and wherein said duplex return path is a bidirectional sheet feeding path with a reversible drive selectively driven in forward and reverse sheet feeding directions, wherein in said higher productivity simplex print job printing mode said duplex return path of said second printing engine is driven in said reverse sheet feeding direction, and wherein both said first and second printing engines are capable of independent duplex printing by driving said duplex return path in said forward sheet feeding direction; and/or wherein in an alternatively selectable high productivity duplex job printing mode, sheets printed on one side in said printing path of said first printing engine are fed inverted directly to said said printing path of second printing engine for printing of the opposite side of the same sheet therein and then said sheet is outputted directly to said common output.

As shown in the above-cited and extensive other art, the control of document and copy sheet handling systems in printers, including copiers, may be accomplished by conventionally actuating them by signals from the copier controller directly or indirectly in response to simple programmed commands and from selected actuation or non-actuation of conventional switch inputs by the operator, such as switches selecting the number of copies to be made in that run, selecting simplex or duplex copying, selecting whether the documents are simplex or duplex, selecting a copy sheet supply tray, etc. The resultant controller signals may through conventional software programing conventionally actuate various conventional electrical solenoid or cam-controlled sheet deflector fingers, motors and/or clutches in the selected steps or sequences as programmed. As is also well known in the art, conventional sheet path sensors or switches connected to the controller may be coordinated therwith and utilized for sensing timing and controlling the positions of the sheets in the reproduction apparatus, keeping track of their general positions, counting the number of completed document set copies, etc.

In the description herein the term "sheet" refers to a usually flimsy physical sheet of paper, plastic, or other suitable physical substrate for images, whether precut or web fed. A "copy sheet" may be abbreviated as a "copy". A "job" is normally a set of related sheets, usually a collated copy set copied from a set of original document sheets or electronic document page images, from a particular user, or otherwise related. A "simplex" document or copy sheet is one having its image and page number on only one side or face of the sheet, whereas a "duplex" document or copy sheet has "pages", and normally images, on both sides, i.e., each duplex document and copy is considered to have two opposing sides, faces, or "pages" even though no physical page number may be present.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of this embodiment thereof, including the drawing figure (approximately to scale) wherein:

FIG. 1 is a schematic frontal view of one example of a higher productivity dual printing engine simplex and duplex printing system in accordance with the present invention.

Referring further to the exemplary such system 10 in the FIG. 1 figure, there is shown two individual simplex and duplex laser printers, a first or upstream printer 200 and a second or downstream printer 200*a*, by way of examples thereof, operatively connected together in series to have a common output at a conventional shared finisher 12 of any desired type. Since staplers, binders and other finishers for copiers and printers are very well know, they need not be described in detail herein. A common output compiler tray 14 is shown therein. Here, the two printers 200 and 200*a* are the same, and the subscript "a" is used on various common elements of printer 200*a* versus printer 200 for descriptive clarity here, but they need not be. These exemplary printers are further described in the above-cited U.S. Pat. No. 5,337,135 by Michael Malachowski et al. Said U.S. Pat. No. 5,337,135 and other art contains further descriptions of, and cited art, on duplex loop paths for printers and their normal functions, and thus that subject need not be redescribed in detail herein. These two printers 200 and 200*a* here desirably may be basically standard standalone printers in almost all respects, docked together output to input, rather than expensive specially built tandem engine machines.

The two printers 200 and 200*a* here each have a controller, 100 and 101, respectively, and these controllers may be electrically interconnected here as shown to provide the described interconnected functions herein, but are also capable of conventional independent operation. The control of all machine functions, including all sheet feeding, is, conventionally, by the machine controller, as noted above. The controller is preferably a known programmable microprocessor system, as exemplified by extensive prior art, e.g., U.S. Pat. No. 4,475,156 and its references. Plural but interconnecting microprocessors may also be used at different locations.

With reference to printer 200, but equally applicable to printer 200*a* here, in the normal operation of the print engines a "clean" paper copy sheet is supplied from one of the regular paper feed trays 120 or 122 (or optional sheet input 123). The unprinted sheet from sheet trays 120 or 122 is first conveyed in path 113 by vertical transport 124, and then in path 114 by registration transport 125 past the image transfer station 126 to receive an image from photoreceptor 128, and then is passed through fuser 130 where the transferred image is permanently fixed or fused to the sheet. The image transferred is conventionally exposed and developed on the photoreceptor 128 in a well known manner. Here the photoreceptor latent image is formed conventionally by laser imaging from digital document page electronic manipulation and storage. After passing the imaged sheet through the fuser 130, gates 134 and 137 in the sheet path then allow the sheet to move directly via output path 116 (which here is connected to the input path 123*a* of the next print engine module 200*a*), as in the normal case of printing a simplex sheet.

Alternatively, if normal single engine duplexing were to be utilized, the gates 134 and 137 would be actuated to respectively deflect the sheet first into inverter 136 and then up into the duplex path 112 comprising rollers N1 to Nn driven with a reversible drive 180. For such normal duplexing, in path 112, these duplex path rollers are driven so that the duplex return path is from right to left in this Figure, as shown by the path 112 movement arrows. This is if the sheet is to completed as a duplex sheet in and by only one printing module 200 (or 200*a*) printing both side one and side two images thereon.

An insert or interposed sheet, such as a cover, photo, tab sheet or any other special sheet, may be optionally fed into optional sheet input 123 and then via an actuated path gate 123*b* there (or reversal of the adjacent rollers) fed into the left hand end of the duplex return path while that path is being reverse driven as a reversed path 113 by reversible drive 180, as shown by those movement arrows, to bypass the image transfer and fusing stations 126, 130. That is, using a reversed duplex return path to pass the insert or interposed sheet over the top of the printing system of the printer 200, from one side to the other, without contamination thereby, by using the existing duplex path loop which is in that position, at no additional hardware expense for that added feature and benefit. (As will be described, this same duplex loop bypass path provides even further functions when the printer is in the downstream printer 220*a* position in the disclosed serial operation for simplex printing.)

Preferably here the normal duplexing operation (of a single print engine) is not the normal duplexing mode, and not used for duplexing except when there is a partial jam or failure. Here, for a doubling increase in duplexing productivity over a single printer, the sheet to be duplexed is treated as a simplex sheet in both printers 200 and 200*a*, and printed on only one side in each printer. Actually, the copying rate in this dual engine duplex mode will more than double for many jobs as compared to a single duplex printer, since in a single engine printer unless the duplex loop is maintained fully filled there are skipped printing pitches. This is accomplished here by printing only one side of each sheet in printer 200, inverting the sheet in inverter 136, and then directly conveying the sheet via output path 116 of printer 200 to the input path 123*a* of the next print engine module 200*a*, to its registration transport 125*a* and image transfer station 126*a* to receive that sheets proper second side image from photoreceptor 128*a*. The duplexed sheet then passes through fuser 130*a* and gates 134*a* (actuated to invert in inverter 136*a* for face down output, as here) and gate 137*a*, to allow the sheet to move directly via output 116*a* to the finisher 12 compiler 14, or a stacker. Note that the duplex loop path is not used in either printer in this dual engine duplex mode.

Turning now to the subject disclosed higher productivity simplex system example, the printing of a simplex job is similar to that for dual engine duplex printing described above. A first simplex sheet (page one) may be printed on one side only in printer 200*a* and outputted directly via its output 116*a*. However, printer 200 is meanwhile printing the second page of the same simplex job set, and outputting that simplex page to the print module 200*a* input 123*a*. That second simplex page from printer 200 is deflected by a gate 123*c* in the entrance to printer 200*a* into the duplex return path 113*a*, which is reverse driven from left to right here by its reverse drive 180*a*, so that the sheets printed by printer 200 are stream fed through the reversed duplex loop path 113*a*, which now functions as a bypass of the printing operations in printer 200*a*. This bypassing simplex page two is then fed through gate 137*a*, which is opened to allow those bypassed sheets from printer 200 to go directly into output path 116*a*. Thus, the simplex sheets from printer 200 interleave with the alternate pages of simplex sheets being substantially simultaneously or overlappingly printed by printer 200*a*. Thus, said simplex page two stacks on top of simplex page one in the output tray 14 in this example. The two print engines thus both print simplex jobs at their full rate, without skipped pitches, and yet their combined merged output is interleaved into fully collated simplex job sets. The respective image formation times in the two printers may of course be synchronized to the sheet path length and velocity to insure this interleaving in the common output path 116*a*, and/or a separate output path may be provided from the bypass path 113*a* to the stacking tray 14. Either print engine can start by printing page one first, as long as they alternate page printing thereafter, although since the second printer is closer to the output it is logical to start printing there. The dividing up of the pages to be printed between the two printers is of course done electronically in the print controllers.

Describing this disclosed dual engine simplexing system in other words, an efficient use of dual serial duplex loop path print engines for high productivity simplex as well as high productivity duplex is provided, using a reversed duplex path loop as a bypass. As will be further described, this can also enable reversed duplex path bypass of a disabled one of the two print engines. Simplex page one from the downstream printer can print and directly output to the finisher or stacker at its output, while meanwhile simplex page two, printed in the meantime by the first print engine, is outputted to the second print engine but passed through the second print engines reversed duplex path as a printing bypass, and on to the output of the second printer, merging there with page one. This is immediately followed by directly outputting page 3 from the second print engine, then page 4 from the first engine via this bypass of the second engine, etc. Only one finishing module is needed, at the output of the second printer, for either simplex or duplex. As noted, the order in which the pages are printed could be reversed, i.e., page one could be printed in the upstream printer, page two in the downstream printer, etc.

Note also that reversing the duplex loop path direction may not be required if a machine can have a suitable duplex path normally running in the opposite direction, from its input to its output side, instead of the opposite as here. The disclosed system, however, exploits the unique "over the top", and fully extending from side to side, duplex loop path of the disclosed printer configuration. However, a duplex path loop can also extend from one side to the other of a printer under rather than over the printing apparatus, as disclosed in the above cited 1994 XDJ publication, for example.

An additional feature of such a tandem print engines configuration is that if one engine fails, the other print engine can still be utilized. The normal single engine duplexing operation can be used in this case, as described above, or normal simplex printing in one engine. Such a "limp mode", as such a partial failure operating mode can be called, can optionally use the duplex path in a reversed bypass mode 113*a* in the second print engine 200*a*, as described above. By actuation of gate 134 or 134*a* the sheet inverter 136 and/or 136*a* here may be used to maintain proper face up or face down sheet orientation in the output in any such mode of operation.

While this invention has been described in conjunction with a specific embodiment thereof, many alternatives, modifications and variations will be apparent to those skilled in the art. It is intended to embrace all such alternatives, modifications and variations as fall within the spirit and scope of the appended claims.

What is claimed is:

1. In a dual engine printing system for producing a multipage print job with first and second printing engines, by passing sheets to be printed through both said first and second printing engines, in that order, to a common output from said second printing engine, and wherein said first and second printing engines each have a printing path therethrough with an entrance and exit, the improvement in said dual engine printing system wherein:

said second printing engine has a duplex return path bypassing said printing path of said second printing engine, said duplex return path extending substantially from one side of said second printing engine to the other side to optionally return sheets printed on one side from said printing path exit back to said printing path entrance of said second printing engine, and wherein a higher productivity simplex print job printing mode is provided in which alternate pages of a simplex print job are substantially simultaneously printed in said first and second printing engine, and wherein said alternate pages of the said simplex print job printed in said first printing engine in said higher productivity simplex printing mode are fed from said exit of said printing path of said first printing engine to said second printing engine duplex return path to bypass said printing path of said second printing engine, and wherein said alternate pages from said first printing engine are automatically interleaved in said common output with said alternate pages printed in said second printing engine after said alternate pages from said first printing engine have fed through said second printing engine duplex return path.

2. The dual engine printing system of claim 1, wherein said duplex return path is a bidirectional sheet feeding path with a reversible drive selectively driven in forward and reverse sheet feeding directions, and wherein in said higher productivity simplex print job printing mode said duplex return path is driven in said reverse sheet feeding direction.

3. The dual engine printing system of claim 1, wherein said duplex return path comprises a loop path extending through said second printing engine above said printing path thereof.

4. The dual engine printing system of claim 1, wherein said first and second printing engines are substantially identical independent duplex printing engines capable of independent simplex and duplex printing.

5. The dual engine printing system of claim 1, wherein said first and second printing engines are substantially identical, and wherein both have said duplex return path, and wherein said duplex return path is a bidirectional sheet feeding path with a reversible drive selectively driven in forward and reverse sheet feeding directions, wherein in said higher productivity simplex print job printing mode said duplex return path of said second printing engine is driven in said reverse sheet feeding direction, and wherein both said first and second printing engines are capable of independent duplex printing by driving said duplex return path in said forward sheet feeding direction.

6. The dual engine printing system of claim 1, wherein in an alternatively selectable high productivity duplex job printing mode, sheets printed on one side in said printing path of said first printing engine are fed inverted directly to said said printing path of second printing engine for printing of the opposite side of the same sheet therein and then said sheet is outputted directly to said common output.

* * * * *